US005626188A

United States Patent [19]

Dewar et al.

[11] Patent Number: 5,626,188

[45] Date of Patent: May 6, 1997

[54] COMPOSITE MACHINED FIN HEAT EXCHANGER

[75] Inventors: Douglas M. Dewar; Alexander F. Anderson, both of Rolling Hills Estates; Christopher K. Duncan, Long Beach, all of Calif.

[73] Assignee: AlliedSignal Inc., Morris Township, N.J.

[21] Appl. No.: 422,207

[22] Filed: Apr. 13, 1995

[51] Int. Cl.[6] ..... F28D 1/03

[52] U.S. Cl. ..... 165/166; 165/905; 165/DIG. 356

[58] Field of Search ..... 165/166, 905

[56] References Cited

U.S. PATENT DOCUMENTS

| | | | |
|---|---|---|---|
| T911,013 | 6/1973 | Morgans et al. . | |
| 1,662,870 | 3/1928 | Stancliffe | 165/166 |
| 3,854,186 | 12/1974 | Sergeys . | |
| 4,017,347 | 4/1977 | Cleveland | 156/89 |
| 4,130,160 | 12/1978 | Dziedzic et al. . | |
| 4,263,966 | 4/1981 | Ostbo . | |
| 4,263,967 | 4/1981 | McNab et al. . | |
| 4,355,684 | 10/1982 | Caines | 165/154 |
| 4,362,209 | 12/1982 | Cleveland | 165/166 |
| 4,434,845 | 3/1984 | Steeb | 165/153 |
| 4,577,678 | 3/1986 | Frauenfeld et al. . | |
| 4,615,379 | 10/1986 | Kunzel . | |
| 4,771,826 | 9/1988 | Grehier et al. . | |
| 4,858,685 | 8/1989 | Szucs et al. . | |
| 5,025,856 | 6/1991 | Van Dyke et al. . | |
| 5,180,459 | 1/1993 | Bauer et al. | 156/89 |
| 5,205,037 | 4/1993 | Kuriki . | |
| 5,249,359 | 10/1993 | Schubert et al. . | |

*Primary Examiner*—Allen J. Flanigan
*Attorney, Agent, or Firm*—John R. Rafter

[57] ABSTRACT

Heat exchangers machined form a thermally oriented block of composite material is provided. First and second arrays of fins can be machined into opposite sides of the block. Composite plates can be disposed over the machined fins to form passageways. The composite plates and fins are specially constructed to maximize heat transfer between adjacent passageways formed by the plates and the fluids flowing in these passageways.

15 Claims, 1 Drawing Sheet

COMPOSITE MACHINED FIN HEAT EXCHANGER

This invention relates to heat exchangers and more particularly to heat exchangers constructed of a plurality of composite plates disposed in a substantial parallel stacked relationship and spaced from each other by composite fins machined into both sides of a single block. The composite plates and fins are specially constructed to maximize heat transfer between adjacent passageways formed by the plates and the fluids flowing in these passageways.

BACKGROUND

In two fluid, parallel plate heat exchangers constructed of metal parts, typically a hot fluid flows between first and second adjacent plates and transfers heat to the plates. This will be referred to as the hot passageway. A cold passageway, transverse or parallel to the hot passageway is constructed on the opposite side of the second plate. A second and cooler fluid flows in this passageway. These hot and cold passageways are alternated to form a stacked array. Metal fins are provided between adjacent plates to assist the transfer of heat from the fluid in the hot passageway through the plate to the cold fluid in the second passageway. These fins are bonded to the plates providing extended heat transfer area and sufficient structural support to provide pressure containment of the fluids. To minimize flow blockage, the fins are disposed in parallel with the fluid flow and define a flow path with minimum additional flow resistance. In addition, the thickness and number of fins is such to provide a maximum heat transfer area in contact with the fluid. A thin fin satisfies these requirements and many different detailed geometry's are used to best satisfy the specific requirements of any given design problem.

Heretofore composite materials have been considered unavailable for these compact parallel plate heat exchangers. It has been considered impossible to achieve a composite fin which is sufficiently thin, sufficiently conductive and could be formed into an acceptable shape to be effective in transferring heat between the two fluids. Also, the fins must exhibit sufficient strength to support the stacked construction and provide pressure containment of the fluids.

SUMMARY OF THE PRESENT INVENTION

It is therefore an object of the present invention to provide composite fins of specially constructed materials with a higher thermal conductivity than available metals to facilitate the transfer of heat between adjacent plates in parallel plate heat exchangers.

Another object of this invention is to employ composite material construction in a heat exchanger thereby providing an improved and lightweight heat exchanger. Specific conductivity (thermal conductivity/density) is a suitable figure of merit for materials used in heat exchanger construction. Aluminum has the highest specific conductivity of all conventional heat exchanger metals with a value of 81 watts per meter K/grams per cubic centimeter. Composite materials to be used in this invention have specific conductivity's 1.5 to 2.5 times higher than aluminum or approximately in the range of 121.5–202.5 watts per meter K/grams per cubic centimeter.

Another object of this invention is to use the greatly reduced coefficient of thermal expansion of these composite materials to reduce thermal stresses and provide prolonged operating life.

Another object of the invention is also directed at prolonging service life by the inherent improved corrosion resistance of composite materials.

Heat exchangers can be machined form a thermally oriented block of composite material. First and second arrays of fins can be machined into opposite sides of the block to a predetermined depth. Composite plates can be disposed over the machined fins to form passageways. The composite plates and fins are specially constructed to maximize heat transfer between adjacent passageways formed by the plates and the fluids flowing in these passageways. Machined blocks can be stacked to and form a heat exchanger comprising an integrated array of thermally oriented machined blocks and composite plates.

BRIEF DESCRIPTION OF THE DRAWINGS

These and other objects and features and advantages will become more apparent from the following detailed description of the invention shown in the accompanying drawing wherein.

DETAILED DESCRIPTION OF THE PREFERRED EMBODIMENTS

Figure 1:
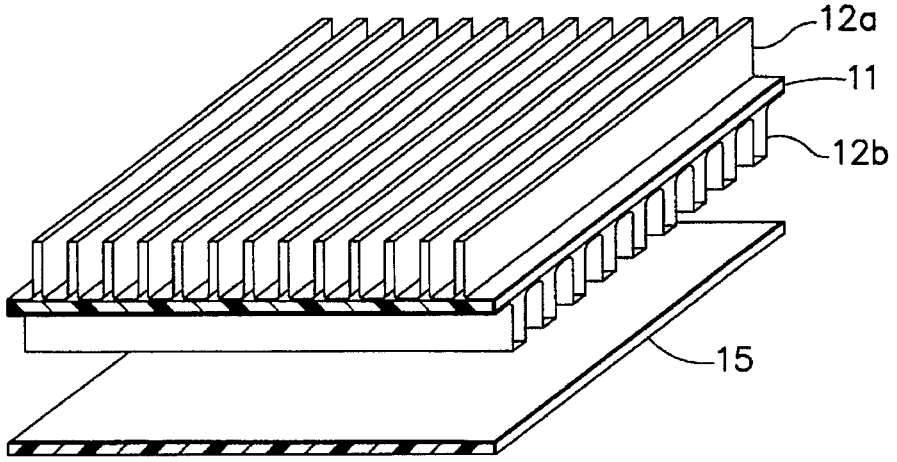
FIG. 1 is an illustration of the composite machined block which is the basic element of this invention.

Referring now to FIG. 1, the drawing of the basic element, the machined plate 11 can be formed from a solid block of composite material having preferably a rectangular shape with a first array of parallel fins 12*a* cut in one face of the block and a second array of parallel fins 12*b* can be cut into the opposite side of the block. It is preferred that the second array of fins 12*b* be oriented in a direction transverse direction to the first array of fins 12*a*. The two sets of fins 12 a and 12*b* are machined into the block to a depth where the remaining material defines a plate 11 of sufficient thickness to provide separation of the two fluids given properties of the fluid such as temperature and pressure.

Figure 2:
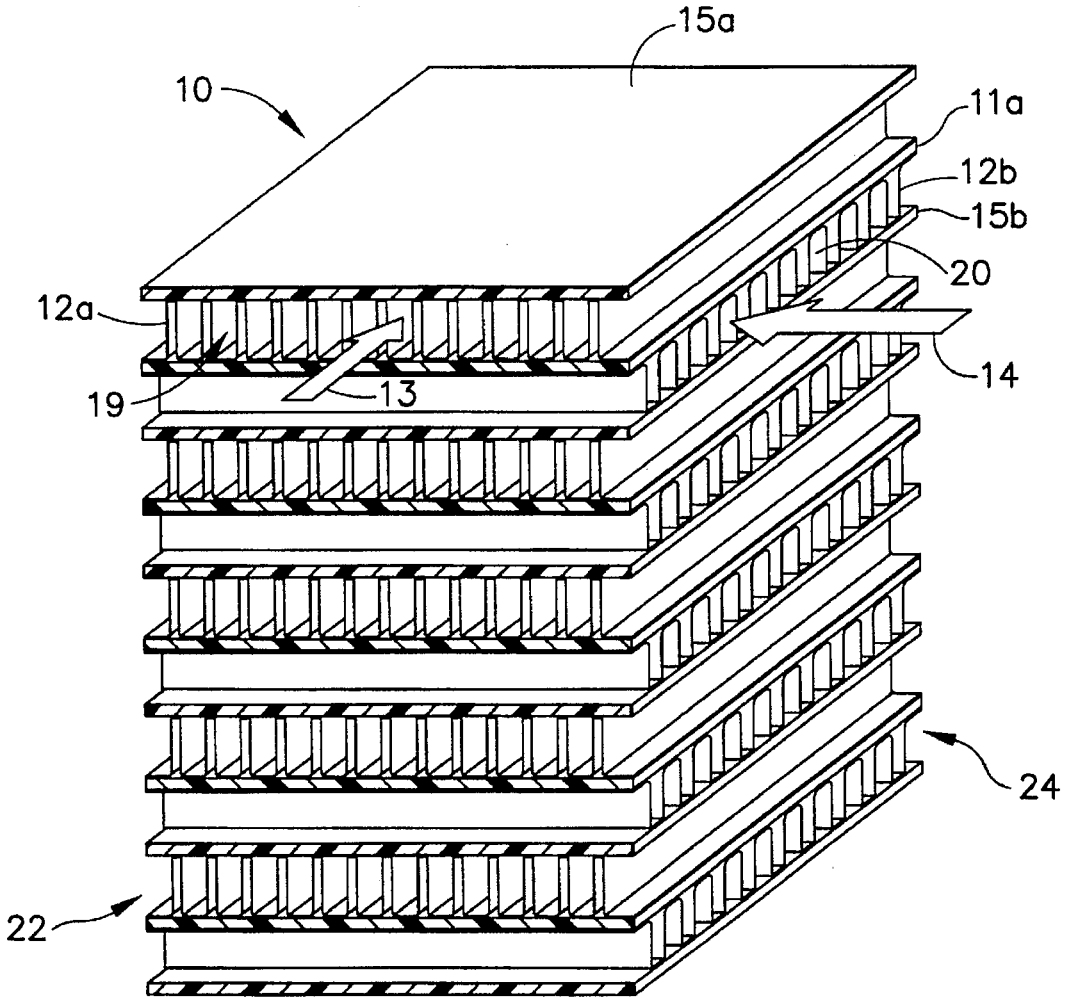
FIG. 2 is the overall machined fin heat exchanger in accordance with this present invention.

Referring now to the drawing in FIG. 2, a heat exchanger 10 can include a plurality of the machined plates 11 shown in FIG. 1 separated by alternating flat plates 15 bonded to the tips of two adjacent fin arrays 12*a* and 12*b*. It is intended that fluids 13 and 14, such as air or any other fluid, flow across the fins 12*a* and 12*b* while contained by the plates 11 and 15. In the integrated stacked assembly of FIG. 2 a first fluid 13 flows between plates 11*a* and 15*a* while fluid 14 flows between plates 11*a* and 15*b*. These two passageways formed by the plates 11*a*, 15*a* and 15*b* are identified for convenience as the hot passageway 19 and the cold passageway 20. The second passageway 20 is most frequently oriented to facilitate the flow of the second fluid 14 transverse to the flow of the first fluid 13 in the first passageway 19. In a preferred embodiment the plates 11 and 15 can be stacked to form alternating first and second passageways 19 and 20 until the assembly as a whole provides the required heat transfer or exchange capability.

Each fin 12*a* and 12*b* has a substantially planar heat transfer surface for insertion within the fluid flow such that the plane of the fin is substantially parallel to the direction of the flow of the fluid to thereby minimize the flow resistance that the fin would otherwise impose on the flowing fluid.

The fins 12*a* and 12*b* can be made in different heights A and B (FIG. 2) to best match the requirements of the two fluid streams, thus passageways 19 and 20 may be of different heights. Fin surface geometry may be altered to enhance the transfer of heat from the fluids to the heat exchanger material. Surface enhancements 21 may be in the form of fin perforations or any form of artificial surface roughness.

In operation, the first and second fluids 13 and 14 flowing in the first and second passageways 19 and 20 respectively are preferably at different temperatures to facilitate the heat transfer from one passage to the other. For instance the first fluid 13 can be hotter than the second fluid 14. When this hotter fluid 13 flows in the first passageway 19 heat is transferred from the fluid to the first fins 12*a* and to the plate 11*a*. Heat is then transferred from this plate 11*a* to the fins 12*b* in the passageway 20 and to the cooler fluid 14. The second fluid 14 exits and flows from the heat exchanger 10 and carries the exchanged heat away from the heat exchanger 10 allowing the continuous flow of the hot fluid to be continuously cooled be the continuous flow of the cold fluid.

In accordance with the present invention the higher thermal conductivity of the composite material can be used to facilitate the heat transfer between the two fluids. The possible anisotropic nature of some composite materials can also be accommodated in this design. The lower density of the material can be used to reduce weight.

The two fluids in addition to the inherently unequal temperatures are at unequal pressures. The plates 11 and 5 must be of a thickness sufficient to provide structural integrity between fluid passages 19 and 20 but sufficiently thin to minimize weight and not interfere with heat transfer. Plate thickness must be gaged to account for the fluid pressure difference between passageways 19 and 20 as this difference tends to bend the plates. The close spacing of the fins 12*a* and 12*b* results in small unsupported cross sectional areas of the plates 1 and 5. Therefore, the fins 12*a* and 12*b* enhance structural integrity and help keep the plates flat.

The purpose of the heat exchanger is to transfer heat from one fluid to the other. Therefore if the hot fluid enters the passageway 19 as shown in the drawing, the inlet end of passage 19 is hotter than the exit end. Similarly, the cold fluid entering the passageway 20 is colder at the inlet and warmer at the exit. Thus, the corner of the heat exchanger where the hot fluid enters and the cold fluid exits 22 may be at a much higher temperature than the opposite corner 24 where the cold fluid enters and the hot fluid exits. This thermal gradient within the heat exchanger structure reduces the amount of heat which can be transferred. In metal heat exchangers the hot section expands much more than the cold section which sets up adverse stresses within the material and reduces heat exchanger life. Repeated cycling of temperatures caused by varying operating conditions and by turning flows off and on still further reduces strength and life by the repeated expansion and contraction of all parts of the heat exchanger.

A method of improving heat exchanger performance and extending life is to use the correct selection of composite materials. Fibers, used in the construction of composite materials, are presently available which have a wide range of thermal conductivity's. Additionally, composite materials may be anisotropic or isotropic dependent on how the fibers are oriented within the material. Isotropic materials conduct heat substantially uniformly along all three orthogonal axes X, Y and Z while anisotropic materials conduct heat predominantly along a first axis such as the Z- axis and to a lesser extent along the remaining two X and Y axes.

In the heat exchanger of this invention high conductivity in the fins 12*a* and 12*b* in the direction between the two plates 1 and 5 (the Z axis) is essential. Plate conductivity in this axis also affects performance but as the cross section area is large and the heat flow length is very short (plate thickness ) this is much less important than the fin conductivity. For this reason, it is beneficial to make the heat transfer along the Z-axis significantly greater than that along the X and Y axes. Thus the Z axis would be the predominant axis of heat transfer. Heat flow from the hot corner to the cold comer is minimized without sacrificing heat flow between the fluids, thus improving performance. One way to create a predominant heat transfer axis is to use an anisotropic material specially oriented to provide a significantly higher thermal conductivity along the primary heat transfer axis and low conductivity along other axes. An additional and very significant benefit in the use of composite materials is that the coefficient of expansion is also much lower than conventional heat exchanger metals and this greatly reduces thermal expansion and the resultant stresses.

In accordance with this invention, it is recognized that a number of different carbon fiber and polymeric resin composites, which may be either isotropic or anisotropic, can be selected to fabricate compact machined fin heat exchangers such that the thermal flux exceeds the value which would be achieved with an identical heat exchanger fabricated from metal. Various other modifications may be contemplated by those skilled in the art without departing from the true spirit and scope of the present invention as here and after defined by the following claims. In addition to the fin geometry and flow configurations mentioned above, the heat exchangers could be formed in other than the illustrated rectangular shape; accordingly heat exchangers of cylindrical, circular or conical configuration are within the scope of the present invention.

What we claim as our invention is:

1. A heat exchanger comprising:

a block of anisotropic fibrous carbon composite material specially aligned to provide a structure having a predominant axis of thermal conductivity specially oriented in a first direction whereby significant heat is transferred along the predominant axis than is transferred along any other orthogonal axis;

first and second arrays of substantially parallel planar fins extending in said first direction and machined along the predominant axis on opposite sides of the block respectively; said fins having tips positioned at their ends projecting in said first direction and a first composite plate bonded to the tips of the array of composite fins to form a passageway.

2. The heat exchanger of claim 1 further comprising a second composite plate is bonded to tips of a second array of composite fins to form a second passageway.

3. The heat exchanger of claim 2 further comprising the first and second passageways are adapted for receiving two non-equal temperature fluids and whereby the fins in the first passageway conduct heat in a first direction from the first passageway to the block and the fins from the second passageway conduct heat in a first direction from the block second into the second passageway.

4. The heat exchanger of claim 3 comprising an integrated stack of alternating first and second passageways of sufficient size to accomplish the desired overall transfer of heat between the two flowing fluids.

5. The heat exchanger of claim 3 wherein the first plate has a cross sectional area coterminous with the cross-sectional area of the bonded fins.

6. The heat exchanger of claim 1 wherein the material of the anisotropic composite block and fins is selected from a class of improved performance and reduced weight materials comprised of a carbon fiber and polymeric resin matrix materials.

7. The heat exchanger of claim 6 wherein the anisotropic composite material of the block and fins provides a low coefficient of expansion and thus significantly reduces stress in the heat exchanger.

8. The heat exchanger of claim 6 wherein the plates and fins exhibit high corrosion resistance to extend heat exchanger service life.

9. The heat exchanger of claim 1 wherein the first and second fin arrays are transverse to each other.

10. The heat exchanger of claim 1 where the first and second fin arrays are parallel to each other.

11. The heat exchanger of claim 1 where the first and second fin arrays have an unequal number of machined fins.

12. The heat exchanger of claim 1 where the first and second fin arrays have different fin heights.

13. The heat exchanger of claim 1 where the fins of the first and second fin arrays are further comprised of fin perforations to maximize heat transfer.

14. The heat exchanger of claim 1 wherein the fins are oriented to provide a primary thermal flux substantially transverse to the plates with an isotropic material.

15. The heat exchanger of claim 1 wherein the block is substantially planar and the predominant axis of thermal conductivity is normal to the plane of the block.

* * * * *